US006557974B1

(12) United States Patent
Weber

(10) Patent No.: US 6,557,974 B1
(45) Date of Patent: May 6, 2003

(54) NON-CIRCULAR PRINTHEAD ORIFICE

(75) Inventor: Timothy L. Weber, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 08/547,885

(22) Filed: Oct. 25, 1995

(51) Int. Cl.[7] ..... B41J 2/14; B41J 2/16
(52) U.S. Cl. ..... 347/47
(58) Field of Search ..... 347/47, 65

(56) References Cited

U.S. PATENT DOCUMENTS

| | | | | |
|---|---|---|---|---|
| 3,958,249 A | * | 5/1976 | DeMaine et al. | 347/75 |
| 4,550,323 A | | 10/1985 | Gamblin | 347/76 |
| 4,550,326 A | * | 10/1985 | Allen et al. | 347/44 |
| 4,578,687 A | | 3/1986 | Cloutier et al. | 347/44 |
| 4,675,693 A | * | 6/1987 | Yaro et al. | 347/47 |
| 4,694,308 A | * | 9/1987 | Chan et al. | 347/65 |
| 4,701,766 A | * | 10/1987 | Sugitani et al. | 347/20 |
| 4,791,436 A | | 12/1988 | Chan et al. | 347/47 |
| 4,823,149 A | | 4/1989 | Martner et al. | 347/71 |
| 4,829,319 A | | 5/1989 | Chan et al. | 347/47 |
| 4,847,639 A | * | 7/1989 | Sugata et al. | 347/62 |
| 4,967,208 A | | 10/1990 | Childers | 347/56 |
| 5,305,015 A | | 4/1994 | Schantz et al. | 347/47 |
| 5,361,087 A | * | 11/1994 | Tajima et al. | 347/44 |
| 5,451,993 A | | 9/1995 | Takahashi et al. | 347/47 |

FOREIGN PATENT DOCUMENTS

| | | | |
|---|---|---|---|
| EP | 0352468 | 6/1989 | B41J/2/16 |
| EP | 0495663 | 1/1992 | B41J/2/14 |
| EP | 0549211 A1 | 12/1992 | B41J/2/14 |
| EP | 0577383 | 6/1993 | B41J/2/16 |
| JP | 04029850 | 1/1992 | B41J/2/045 |

OTHER PUBLICATIONS

"The ThinkJet Orifice Plate: A Part With Many Functions"; by Gary L. Siewell, William R. Boucher, and Paul H. McClelland: Hewlett–Packard Journal—May 1985; pp 33–37.

"Thermal Inkjet Review, Or How Do Dots Get From The Pen To The Page?"; by James P. Shields; Hewlett–Packard Journal—Aug. 1992; pp 67.

"Development Of A High–Resolution Thermal Inkjet Printhead"; by William A. Buskirk, David E. Hackleman, Stanley T. Hall, Paula H. Kanarek, Robert N. Low, Kenneth E. Trueba, and Richard R. Van de Poll; Hewlett–Packard Journal—Oct. 1988; pp 55–61.

* cited by examiner

*Primary Examiner*—John Barlow
*Assistant Examiner*—Michael S Brooke
(74) *Attorney, Agent, or Firm*—Raymond A. Jenski

(57) ABSTRACT

A printhead for an inkjet printer employs non-circular orifices, such as oval or parallelogram, at the surface of the orifice plate to increase the restoring force of the ink meniscus. The reduced tail and diminished spray of an ink droplet expelled from the non-circular orifice results in improved edge roughness and improved quality of print.

21 Claims, 5 Drawing Sheets

– PRIOR ART –

– PRIOR ART –

NON-CIRCULAR PRINTHEAD ORIFICE

BACKGROUND OF THE INVENTION

The present invention generally relates to the design of orifices used in an inkjet printer printhead and more particularly relates to non-circular orifices disposed in the orifice plate of an inkjet printer printhead.

An inkjet printer operates by positioning a medium, such as paper, in conjunction with a printing mechanism, conventionally known as a print cartridge, so that droplets of ink may be deposited in desired locations on the medium to produce text characters or images. The print cartridge may be scanned or reciprocated across the surface of the medium while medium is advanced increment by increment perpendicular to the direction of print cartridge travel. At any given point in the print cartridge travel and medium advancement operation, a command is given to an ink ejector to expel a tiny droplet of ink from the print cartridge to the medium. If the mechanism of ink expulsion is a thermally induced boiling of ink, the ink ejectors consist of a large number of electrically energized heater resistors which are preferentially heated in a small firing chamber, thereby resulting in the rapid boiling and expulsion of ink through a small opening, or orifice, toward the medium.

A conventional print cartridge for an inkjet type printer comprises an ink containment device and an ink-expelling apparatus, commonly known as a printhead, which heats and expels the ink droplets in a controlled fashion. Typically, the printhead is a laminate structure including a semiconductor or insulator base, a barrier material structure which is honeycombed with ink flow channels, and an orifice plate which is perforated with circular nozzles or orifices with diameters smaller than a human hair and arranged in a pattern which allows ink droplets to be expelled. Thin film heater resistors are deposited on or near the surface of the base and are usually protected from corrosion and mechanical abrasion by one or more protective layers. The thin film heater resistors are electrically coupled to the printer either directly via metalization on the base and subsequent connectors or via multiplexing circuitry, metalization, and subsequent connectors. Microprocessor circuitry in the printer selectively energizes particular thin film heater resistors to produce the desired pattern of ink droplets necessary to create a text character or a pictorial image. Further details of printer, print cartridge, and printhead construction may be found in the Hewlett-Packard Journal, Vol. 36, No. 5, May 1985, and in the Hewlett-Packard Journal, Vol. 45, No. 1, February 1994.

Ink flows into the firing chambers formed around each heater resistor by the barrier layer and the orifice plate and awaits energization of the heater resistor. When a pulse of electric current is applied to the heater resistor, ink within the firing chamber is rapidly vaporized, forming a bubble which rapidly ejects a mass of ink through the orifice associated with the heater resistor and the surrounding firing chamber. Following ejection of the ink droplet and collapse of the ink bubble, ink refills the firing chamber and forms a meniscus across the orifice. The form and constrictions in channels through which ink flows to refill the firing chamber establish the speed at which ink refills the firing chamber and the dynamics of the ink meniscus.

One of the problems faced by designers of print cartridges is that of maintaining a high quality of result in print while achieving a high rate of printing speed. When a droplet is expelled from an orifice due to the rapid boiling of the ink inside the firing chamber, most of the mass of the ejected ink is concentrated in the droplet which is directed toward the medium. However, a portion of the expelled ink resides in a tail extending from the droplet to the surface opening of the orifice. The velocity of the ink found in the tail is generally less than the velocity of the ink found in the droplet so that at some time during the trajectory of the droplet, the tail is severed from the droplet. Some of the ink in the severed tail rejoins the expelled droplet or remains as a tail and creates rough edges on the printed material. Some of the expelled ink in the tail returns to the printhead, forming puddles on the surface of the orifice plate of the printhead. Some of the ink on the severed tail forms sub-droplets ("spray") which spreads randomly in the general area of the ink droplet. This spray often lands on the medium to produce a background of ink haze. To reduce the detrimental results of spray, others have reduced the speed of the printing operation but have suffered a reduction in the number of pages which a printer can print in a given amount of time. The spray problem has also been addressed by optimizing the architecture or geometry of the firing chamber and the associated ink feed conduits. In many instances, however, very fine optimization is negated by variables of the manufacturing process. The present invention overcomes the problem of spray and elongated tail without introducing a reduction in print speed or fine ink channel architecture optimizations.

SUMMARY OF THE INVENTION

A printhead for an inkjet printer and methods for making and using the printhead includes an ink ejector and an orifice plate having at least one orifice from which ink is expelled, extending through the orifice from a first surface of the orifice plate abutting the ink ejector to a second surface of the orifice plate. The at least one orifice has a major axis and a minor axis, the major axis having a dimension greater than the dimension of the minor axis. Both the major axis and the minor axis are disposed parallel to the second surface.

DETAILED DESCRIPTION OF A PREFERRED EMBODIMENT

Figure 1:
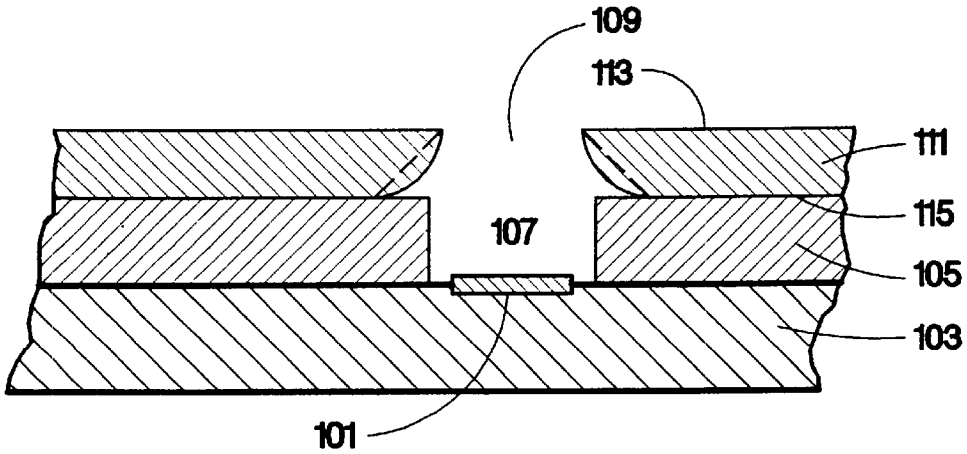
FIG. 1 is a cross sectional view of a conventional printhead showing one ink firing chamber.

A cross section of a conventional printhead is shown in FIG. 1. A thin film resistor 101 employed in the preferred embodiment as an ink ejector, is created at the surface of a semiconductor substrate 103 and typically is connected to electrical inputs by way of metalization (not shown) on the surface of the semiconductor substrate 103. Additionally, various layers of protection from chemical and mechanical attack may be placed over the heater resistor 101, but is not shown in FIG. 1 for clarity. A layer of barrier material 105 is selectively placed on the surface of the silicon substrate 103 thereby leaving an opening or firing chamber 107 around the heater resistor 101 so that ink may accumulate prior to activation of heater resistor 101 and expulsion of ink through an opening or orifice 109. The barrier material for barrier layer 105 is conventionally Parad® available from E. I. Dupont De Nemours and Company or equivalent material. The orifice 109 is a hole in an orifice plate 111 which is typically formed by gold plating a nickel base material. Such a plating operation results in a smooth curved taper from the outer surface 113 of the orifice plate 111 to the inner surface 115 of the orifice plate 111, which faces the firing chamber 107 and the firing resistor 101. The orifice outlet at the outer surface of orifice plate 111 has a smaller radius (and therefore a smaller area of opening) than the orifice plate opening to the firing chamber 107. Other methods of producing orifices, such as laser ablation may be used, particularly with orifice plates of materials other than metal, but such other orifice production methods can generate orifice bores with straight sides, shown in phantom.

Figure 2:
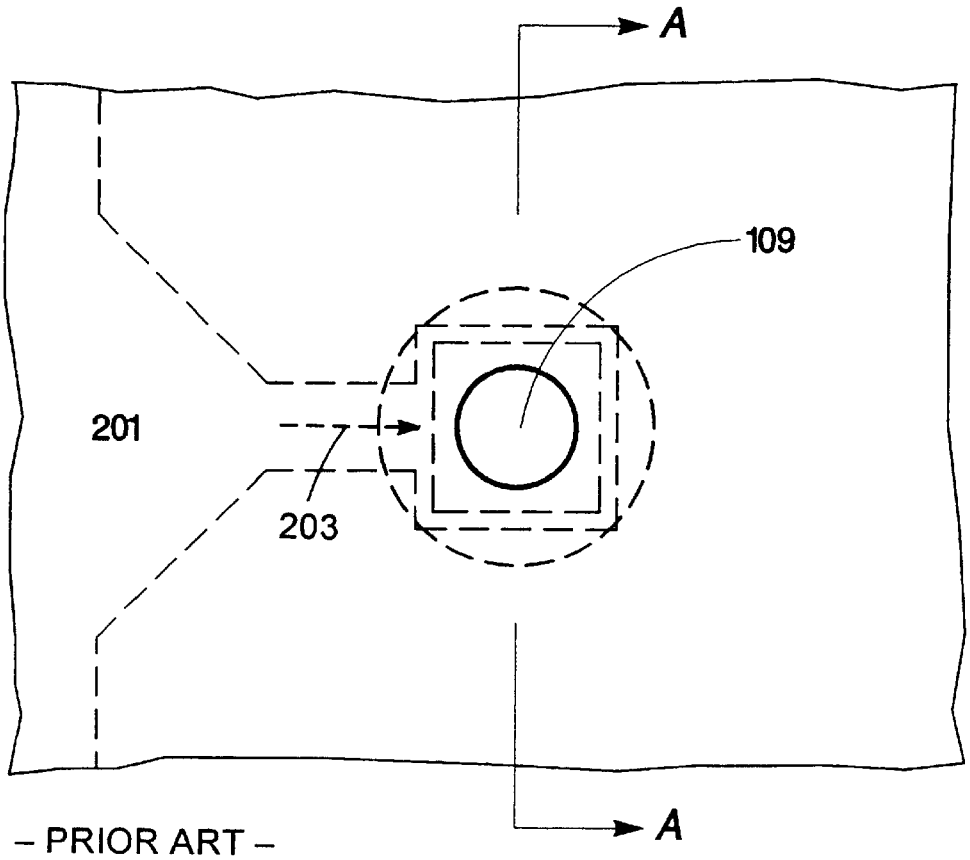
FIG. 2 is a plan view from the outer surface of the orifice plate of the printhead shown in cross section in FIG. 1 and illustrating the section line A—A which defines the cross section.

FIG. 2 is a top plan view of the printhead (indicating the section A—A of FIG. 1), viewing orifice 109 from the outer surface 113 of the orifice plate 111. An ink feed channel 201 is present in the barrier layer 105 to deliver ink to the firing chamber from a larger ink source (not shown) in a direction indicated by the arrow 203.

Figure 3:
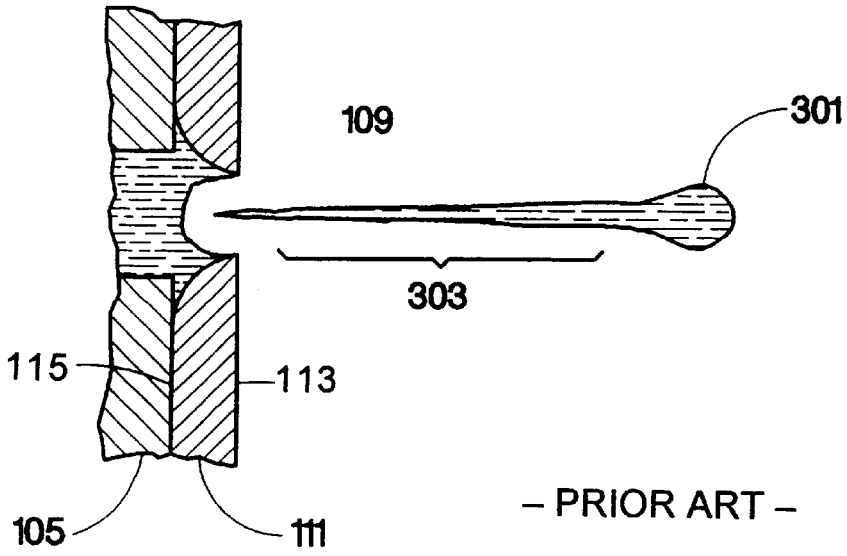
FIG. 3 is a partial cross sectional view through section A—A of the conventional printhead of FIGS. 1 and 2 illustrating the expulsion of an ink droplet.

FIG. 3 illustrates the configuration of ink in an ink droplet 301 at a time of 22 microseconds after the ink has been expelled from the orifice 109. In conventional orifice plates, in which circular orifices are used, the ink droplet 301 maintains a long tail 303 which extends back to at least the orifice 109 in the orifice plate 111. After the droplet 301 leaves the orifice plate and the bubble of vaporized ink which expelled the droplet collapses, capillary forces draw ink from the ink source through the ink feed channel 201. In an underdamped system, ink rushes back into the firing chamber so rapidly that it overfills the firing chamber 107, thereby creating a bulging meniscus. The meniscus then oscillates about its equilibrium position for several cycles before settling down. Extra ink in the bulging meniscus adds to the volume of an ink droplet should a droplet be expelled while the meniscus is bulging. A retracted meniscus reduces the volume of the droplet should the droplet be expelled during this part of the cycle. Printhead designers have improved and optimized the damping of the ink refill and meniscus system by increasing the fluid resistance of the ink refill channel. Typically this improvement has been accomplished by lengthening the ink refill channel, decreasing the ink refill channel cross section, or by increasing the viscosity of the ink. Such an increase in ink refill fluid resistance often results in slower refill times and a reduced rate of droplet ejection and printing speed.

Figure 4:
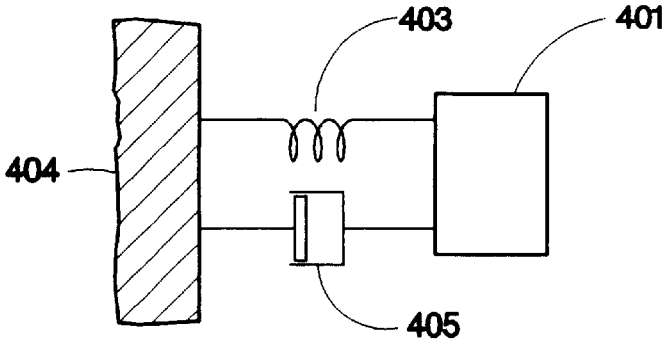
FIG. 4 is a theoretical model of the droplet/meniscus system which may be useful in understanding a feature of the present invention.

A simplified analysis of the meniscus system is one such as the mechanical model shown in FIG. 4, in which a mass 401, equivalent to the mass of the expelled droplet, is coupled to a fixed structure 404 by a spring 403 having a spring constant, K, proportional to the reciprocal of the effective radius of the orifice. The mass 401 is also coupled to the fixed structure 404 by a damping function 405 which is related to the channel fluid resistance and other ink channel characteristics. In the preferred embodiment, the drop weight mass 401 is proportional to the diameter of the orifice. Thus, if one desires to control the characteristics and performance of the meniscus, one may adjust the damping factor of the damping function 405 by optimizing the ink channel or adjusting the spring constant of spring 403 in the mechanical model.

Figure 6A:
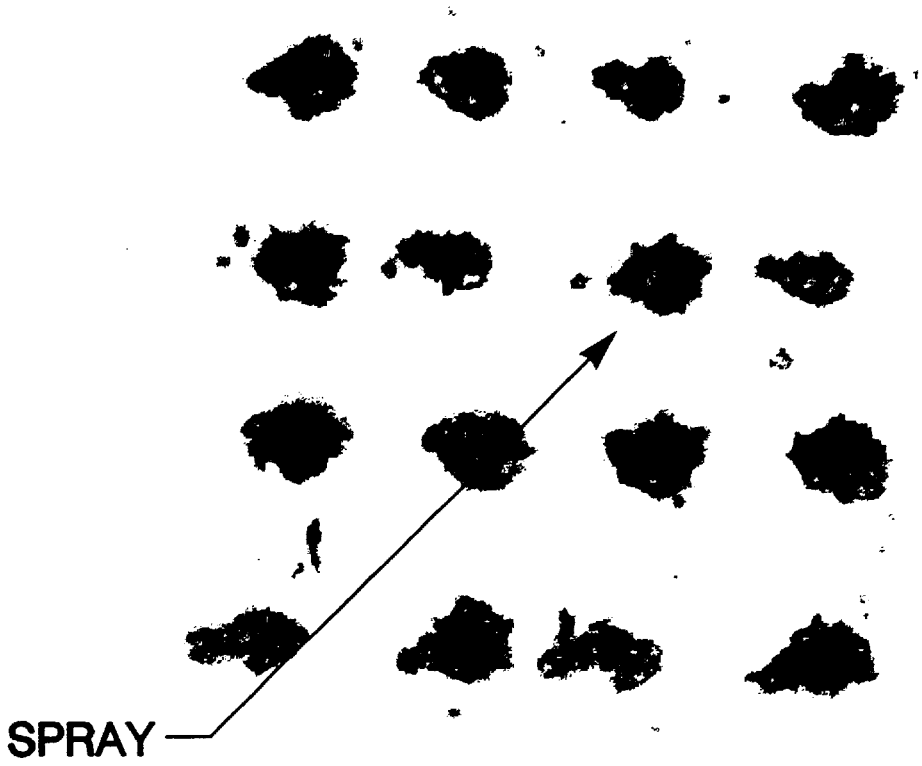
FIG. 6A is a reproduction of the detrimental effects of spray and elongated tail upon a printed medium.

Returning again to FIG. 3, when the droplet 301 is ejected from the orifice most of the mass of the droplet is contained in the leading head of the droplet 301 and the greatest velocity is found in this mass. The remaining tail 303 contains a minority of the mass of ink and has a distribution of velocity ranging from nearly the same as the ink droplet head at a location near the ink droplet head to a velocity less than the velocity of the ink found in the ink droplet head and located closest to the orifice. At some time during the transit of the droplet, the ink in the tail is stretched to a point where the tail is broken. A portion of the ink remaining in the tail is driven back to the printhead orifice plate 111 where it typically forms puddles of ink surrounding the orifice. These ink puddles degrade the quality of the printed material by causing misdirection of subsequent ink droplets. Other parts of the ink droplet tail are absorbed into the ink droplet head prior to the ink droplet being deposited upon the medium. Finally, some of the ink found in the ink droplet tail neither returns to the printhead nor remains with or is absorbed in the ink droplet, but produces a fine spray of subdroplet size spreading in a random direction. Some of this spray reaches the medium upon which printing is occurring thereby producing rough edges to the dots formed by the ink droplet and placing undesired spots on the medium which reduces the clarity of the desired printed material. Such an undesired result is shown in the representation of printed dots in FIG. 6A.

Figure 5:
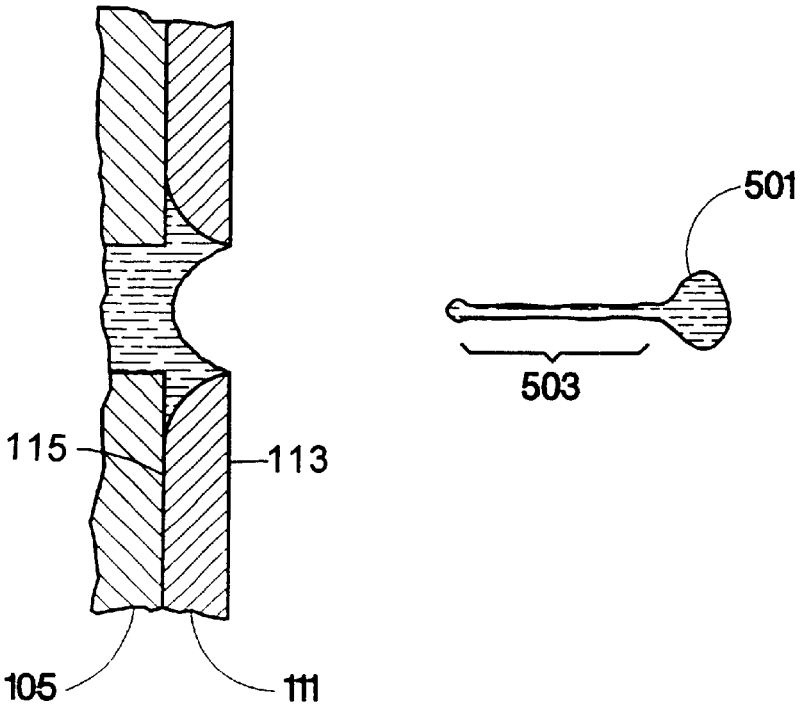
FIG. 5 is a cross sectional view through a section equivalent to the foregoing section A—A of a printhead employing the present invention and illustrating the expulsion of an ink droplet.
Figure 6B:
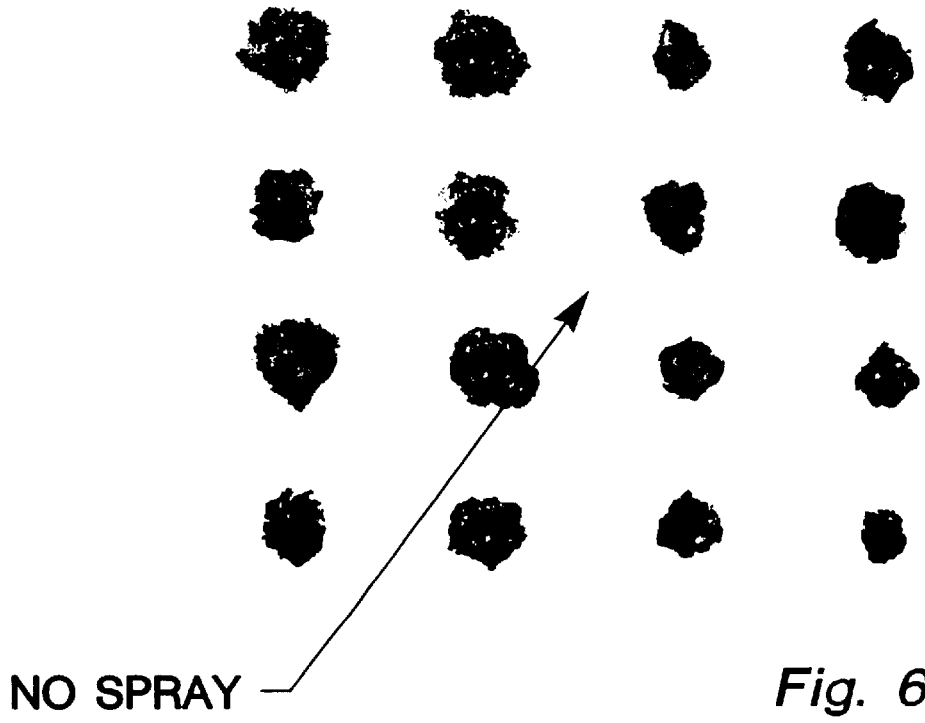
FIG. 6B is a reproduction of a printed medium following introduction of the is present invention into a printhead.

It has been determined that the exit area of the orifice 109 defines the drop weight of the ink droplet expelled. It has further been determined that the spring constant K in the model (the restoring force of the meniscus) is determined in part by the proximity of the edges of the opening of the orifice bore hole. Thus, to increase the stiffness of the meniscus, the sides and opening of the orifice bore hole should be made as close together as possible. This, of course, is in contradiction to the need to maintain a given drop weight for the droplet (which is determined by the exit area of the orifice). It is a feature, then, of the present invention that that exit of the orifice bore hole be of a non-circular geometry. A greater restoring force on the meniscus provided by the non-circular geometry causes the tail of the ink droplet to be broken off sooner and closer to the orifice plate thereby resulting in a shorter ink droplet tail and substantially reduced spray. Such an effect is shown in FIG. 5 which illustrates an ink droplet 22 microseconds after being ejected from the orifice 501. The ink droplet tail 503 has been broken off sooner and is shorter than that created by the circular orifice of FIG. 3. Printed dots resulting from the ink droplet ejected from non-circular orifices is shown in FIG. 6B. It is notable that spray has been essentially eliminated from this resulting sample and the edge roughness has been substantially improved.

The non-circular orifices in the preferred embodiment are elongate apertures having a major axis and a minor axis, in which the major axis is of a greater dimension than the minor axis and both axes are parallel to the outer surface of the orifice plate. Such elongate structures can be rectangles and parallelograms or ovals such as ellipses and parallel-sided "racetrack" structures. For ease of manufacture, the oval class of elongate apertures were employed in the preferred embodiment. Using the ink found in model no HP51649A print cartridges, available from Hewlett-Packard Company, and orifice surface opening areas equal to the area of the orifice surface opening area found in the HP51649A cartridge it was determined that the range of effective operation for an ellipse having a major axis to minor axis ratio of from 2 to 1 through a major axis to a minor axis ratio of 5 to 1 demonstrated the desired meniscus stiffening and short tail ink droplet.

Figure 7A:
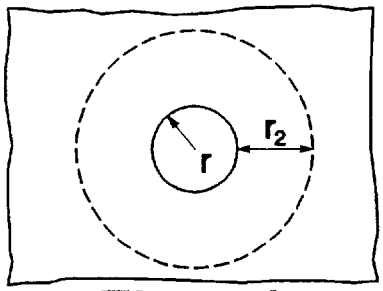
FIGS. 7A–7E are plan views from the outer surface of the orifice plate showing orifice surface apertures which may be employed in the present invention.
Figure 7B:
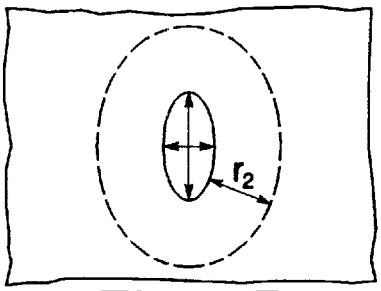
Figure 7C:
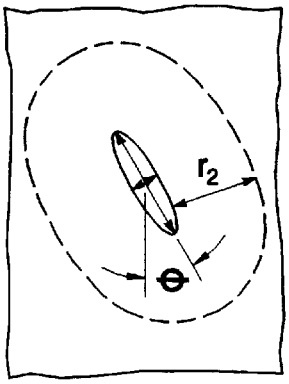
Figure 7D:
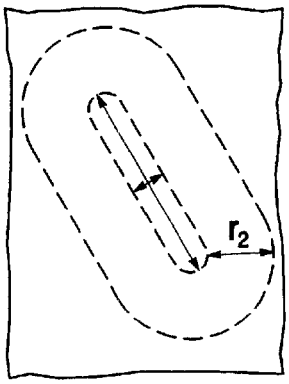
Figure 7E:
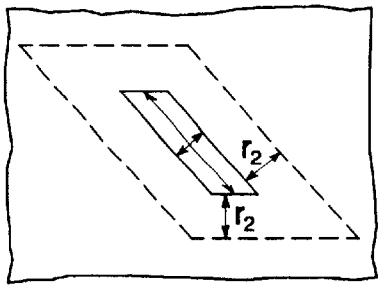

FIGS. 7A–7D are plan views of the orifice plate outer surface illustrating the various types of orifice bore hole dimensions. FIG. 7A illustrates a circular orifice having a radius r at the outer dimension and a difference in radius between the outer dimension r and the opening to the firing chamber of value $r_2$. In the preferred embodiment, r=17.5 micron and $r_2$=45 microns. This yields an aperture area at the orifice plate outer surface ($r^2 \cdot \pi$) of 962 microns$^2$. The arrows drawn across the orifice outside surface aperture indicate the major and minor axes. FIG. 7B illustrates an ellipsoidal outside orifice aperture geometry in which the major axis/minor axis ratio equals 2 to 1 and, in order to maintain an equal droplet drop weight, the outer surface area is maintained at 962 microns$^2$. The inner dimension of the aperture bore maintains a greater size by the later radius increment $r_2$. FIG. 7C illustrates an orifice having a major axis/minor axis ratio of 4 to 1 and an outside aperture area of 962 microns$^2$. FIG. 7D illustrates an oval "racetrack" orifice outside geometry in which the major axis/minor axis ratio is equal to 5 to 1 and a difference of $r_2$. FIG. 7E illustrates a parallelogram orifice outside geometry having a major axis/minor axis ratio of 5 to 1 and a difference between the inside geometry and outside geometry of $r_2$ from the periphery of the outside surface orifice dimension. In the preferred embodiment, those aperture geometries having a major axis/minor axis ratio greater than 2 to 1 require a rotation of approximately 30° (θ=30°) so that adjacent orifices can be spaced closely together.

Figure 8:
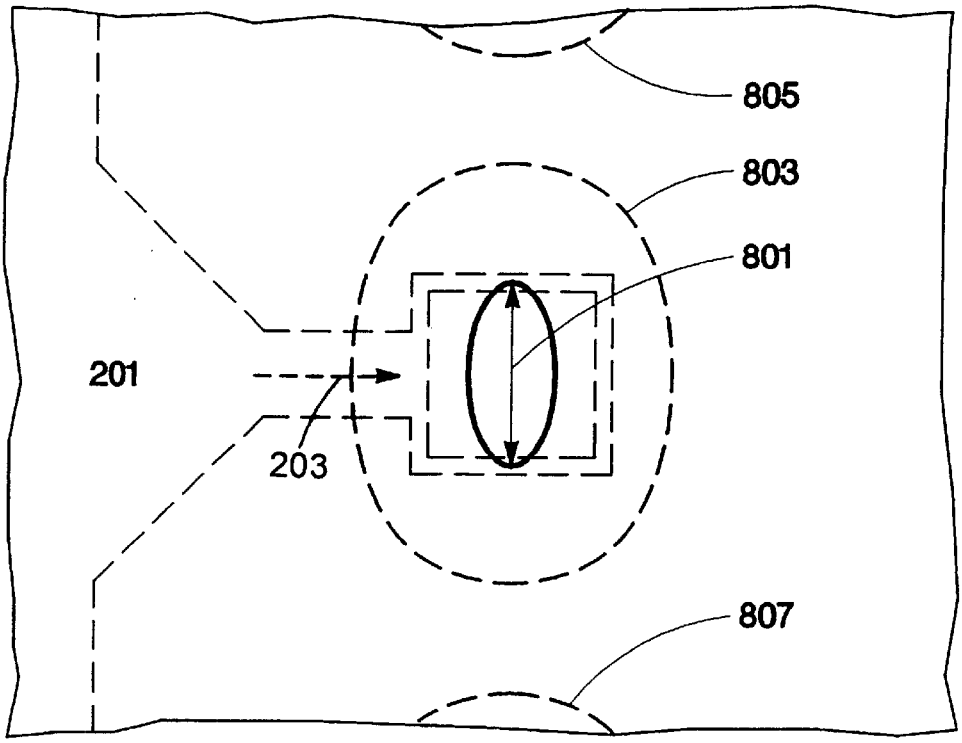
FIG. 8 is a plan view from the outer surface of the orifice plate showing an elongate orifice surface aperture relative to the firing chamber and ink replenishment flow direction.
Figure 9:
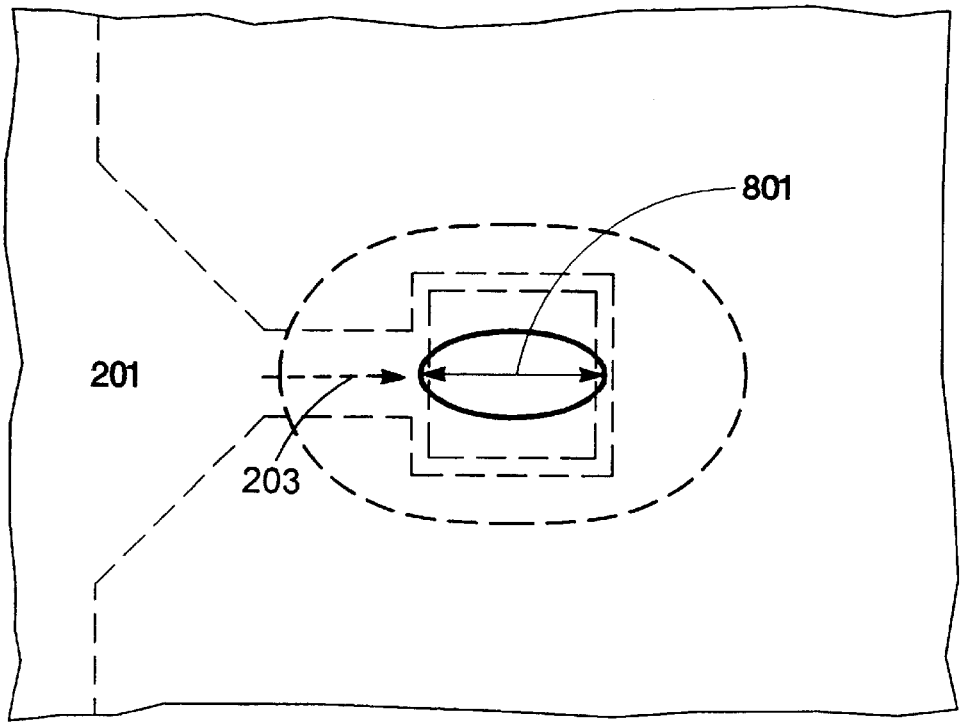
FIG. 9 is a plan view from the outer surface of the orifice plate showing an alternative elongate orifice surface aperture relative to the firing chamber and ink replenishment flow direction.

Referring now to FIG. 8, a plan view of the orifice plate illustrates an orientation of the oval orifice aperture oriented such that the major axis of the oval 801 is oriented perpendicular to the flow of ink in a direction indicated by broken line arrow 203 into the firing chamber via the ink feed channel 201. FIG. 9 illustrates the same oval aperture in which the major axis 801 is oriented parallel to the direction of ink flow indicated by broken line arrow 203 into the firing chamber from the ink feed channel 201. In the preferred embodiment in which the non-circular orifice has a major axis/minor axis ratio greater than 2 to 1 and is oriented perpendicular to the ink flow from the ink feed channel 201, such as shown in FIG. 8, the orifices are oriented at an angle deviating from perpendicularity by θ=approximately 30°. This orientation enables orifices to be closely spaced without causing the inner orifice dimensions 803, 805, 807 to touch or interfere with each other. The angle of deviation from perpendicularity, θ, may range from 0° to 45° in alternative embodiments of the invention. It has been determined that the preferred orientation for orifice plates which are formed of metal, for example gold plated nickel (and which have a curved smoothly tapering orifice bore from outside aperture to inside aperture), the preferred orientation is that of having the long axis of the elongate orifice perpendicular to the direction of ink refill flow from the ink feed channel 201, such as that shown in FIG. 8. For those orifice plates such as those formed of softer materials like polyimide in which the orifices are created by laser ablation (and which have a relatively linear orifice bore from outside aperture opening to inside aperture opening), the preferred orientation is that of having the long axis of the elongate orifice being parallel to the flow of ink from the ink feed channel 201, such as shown in FIG. 9.

Referring again to FIG. 5, the cross section shown in FIG. 5 is that along the major axis of the elongate orifice aperture. The ink droplet head 501, after emerging from the orifice, is a non-spherical ink droplet, distorted in the direction of the major axis of the elongate orifice. The ink droplet oscillates during its flight path to the medium, forming a more conventional teardrop shape by the time it reaches the medium. The droplet has a significantly reduced tail and a significant reduction in spray without sacrificing printing speed and without ink channel optimizations requiring extreme manufacturing tolerances.

What is claimed is:

1. A printhead for an inkjet printer including orifices from which ink is expelled, comprising:

an ink ejector;

an ink ejection chamber surrounding said ink ejector;

an orifice plate having an inner surface and an outer surface and having at least one orifice from which ink is expelled extending through said orifice plate from said inner surface of said orifice plate opposite said ink ejector to said outer surface of said orifice plate, said at least one orifice having an opening at said outer surface with an elliptical shape including a major axis and a minor axis, said major axis having a dimension of from two to five times greater than said minor axis, each said major and minor axis parallel to said outer surface;

an ink feed channel coupled to said ink ejection chamber and oriented in a direction to supply ink into said ejection chamber; and wherein said major axis is aligned substantially perpendicularly to said ink feed channel direction which supplies ink into said ejection chamber and said minor axis is aligned substantially parallel to said ink feed channel direction which supplies ink into said ejection chamber.

2. A printhead in accordance with claim 1 wherein said orifice plate having said at least one orifice further comprises said opening of said at least one orifice at said outer surface having a smaller area and substantially the same geometric shape as an opening of said at least one orifice at said inner surface.

3. A printhead in accordance with claim 2 wherein said orifice plate having said at least one orifice further comprises an arc segment cross sectional geometry joining said opening of said at least one orifice at said outer surface with said opening of said at least one orifice at said inner surface.

4. A printhead in accordance with claim 1 wherein said orifice plate having said at least one orifice further comprises a bore having a curved cross sectional geometry joining said opening of said at least one orifice at said outer surface with said opening of said at least one orifice at said inner surface.

5. A printhead for an inkjet printer including orifices from which ink is expelled, comprising:

an ink ejector;

an ink ejection chamber surrounding said ink ejector;

an orifice plate having an inner surface and an outer surface and having at least one orifice from which ink is expelled extending through said orifice plate from said inner surface of said orifice plate opposite said ink ejector to said outer surface of said orifice plate, said at least one orifice having an opening at said outer surface with an elliptical shape including a major axis and a minor axis, said major axis having a dimension of from two to five times greater than said minor axis, each said major and minor axis parallel to said outer surface;

an ink feed channel coupled to said ink ejection chamber and oriented in a direction to supply ink into said ejection chamber; and wherein said major axis is aligned at an angle ranging between 0° and less than 45° from a perpendicular to said ink feed channel direction which supplies ink into said ejection chamber and said minor axis is aligned substantially perpendicularly to said major axis.

6. A printhead in accordance with claim 5 wherein said orifice plate having said at least one orifice further comprises said opening of said at least one orifice at said outer surface having a smaller area and substantially the same geometric shape as an opening of said at least one orifice at said inner surface.

7. A printhead in accordance with claim 6 wherein said orifice plate having said at least one orifice further comprises an arc segment cross sectional geometry joining said opening of said at least one orifice at said outer surface with said opening of said at least one orifice at said inner surface.

8. A printhead in accordance with claim 5 wherein said orifice plate having said at least one orifice further comprises a bore having a curved cross sectional geometry joining said opening of said at least one orifice at said outer surface with said opening of said at least one orifice at said inner surface.

9. A method of operation of a printhead for an inkjet printer including an ink ejection chamber and orifices from which ink is expelled, comprising the steps of:

conducting ink to the ink ejection chamber by way of an ink feed channel which is oriented in a direction to couple to the ink ejection chamber;

imparting a velocity to a mass of ink; and expelling said mass of ink from at least one non-circular orifice, said at least one non-circular orifice having an opening with an elliptical shape including a major axis and a minor axis, said major axis having a dimension of from two to five times greater than said minor axis, said major axis aligned substantially perpendicularly to said direction of orientation of said ink feed channel and said minor axis aligned substantially parallel to said direction of orientation of said ink feed channel.

10. A method of manufacturing a printhead for an inkjet printer including orifices from which ink is expelled, comprising the steps of:

disposing an ink ejector on a substrate;

forming an ink ejection chamber surrounding said ink ejector;

extending at least one orifice from which ink is expelled through an orifice plate having an inner surface and an outer surface from said inner surface of said orifice plate to said outer surface of said orifice plate, said at least one orifice having an opening at said outer surface with an elliptical shape including a major axis and a minor axis, said major axis having a dimension of from two to five times greater than said minor axis, each said major and minor axis parallel to said outer surface;

overlaying said orifice plate on said ink ejection chamber such that said inner surface is disposed opposite said ink ejector;

orienting an ink feed channel in a direction to deliver ink to said ink ejection chamber; and aligning said major axis substantially perpendicularly to said ink feed channel direction which supplies ink into said ejection chamber and aligning said minor axis substantially parallel to said ink feed channel direction which supplies ink into said ejection chamber.

11. A method in accordance with the method of claim 10 further comprising the stop of creating said at least one orifice having said opening of said at least one orifice at said outer surface with a smaller area and essentially the same geometric shape as an opening of said at least one orifice at said inner surface.

12. A method in accordance with the method of claim 10 wherein said step of extending said at least one orifice through said orifice plate further comprises the step of forming a orifice bore having a curved cross sectional geometry joining said opening of said at least one orifice at said outer surface with said opening of said at least one orifice at said inner surface.

13. A method of manufacturing a printhead for an inkjet printer including orifices from which ink is expelled, comprising the steps of:

disposing an ink ejector on a substrate;

forming an ink ejection chamber surrounding said ink ejector;

extending at least one orifice from which ink is expelled through an orifice plate having an inner surface and an outer surface from said inner surface of said orifice plate to said outer surface of said orifice plate, said at least one orifice having an opening at said outer surface with an elliptical shape including a major axis and a minor axis, said major axis having a dimension of from two to five times greater than said minor axis, each said major and minor axis parallel to said outer surface;

overlaying said orifice plate on said ink ejection chamber such that said inner surface is disposed opposite said ink ejector;

orienting an ink feed channel in a direction to deliver ink to said ink ejection chamber; and aligning said major axis at an angle ranging between 0° and less than 45° from a perpendicular to said ink feed channel direction which supplies ink into said ejection chamber and aligning said minor axis substantially perpendicularly to said major axis.

14. A method in accordance with the method of claim 13 further comprising the step of creating said at least one orifice having said opening of said at least one orifice at said outer surface with a smaller area and essentially the sane geometric shape as an opening of said at least one orifice at said inner surface.

15. A printhead for an inkjet printer including orifices from which ink is expelled, comprising:

an ink ejector;

an ink ejection chamber surrounding said ink ejector;

an orifice plate having an inner surface and an outer surface and having at least one orifice from which ink is expelled extending through said orifice plate from said inner surface of said orifice plate opposite said ink ejector to said outer surface of said orifice plate, said at least one orifice having an opening at said outer surface with an elliptical shape including a major axis and a minor axis, said major axis having a dimension of from two to five times greater than said minor axis, each said major and minor axis parallel to said outer surface;

an ink feed channel coupled to said ink ejection chamber and oriented in a direction to supply ink into said ejection chamber; and wherein said major axis is aligned substantially parallel to said ink feed channel direction which supplies ink into said ejection chamber.

16. A printhead in accordance with claim 15 wherein said orifice plate having said at least one orifice further comprises said opening of said at least one orifice at said outer surface having a smaller area and substantially the same geometric shape as an opening of said at least one orifice at said inner surface.

17. A printhead in accordance with claim 16 wherein said orifice plate having said at least one orifice further comprises said at least one orifice having a straight line cross sectional geometry joining said opening of said at least one orifice at said outer surface with said opening of said at least one orifice at said inner surface.

18. A method of operation of a printhead for an inkjet printer including au ink ejection chamber and orifices from which ink is expelled, comprising the steps of:

conducting ink to the ink ejection chamber by way of an ink feed channel which is oriented in a direction to couple to the ink ejection chamber;

imparting a velocity to a mass of ink; and expelling said mass of ink from at least one non-circular orifice, said at least one non-circular orifice having an elliptical cross sectional opening with a major axis and a minor axis, said major axis having a dimension of from two to five times greater than said minor axis, and aligned substantially parallel to said direction of orientation of said ink feed channel.

19. A method of manufacturing a printhead for an inkjet printer including orifices from which ink is expelled, comprising the steps of:

disposing an ink ejector on a substrate;

forming an ink ejection chamber surrounding said ink ejector;

extending at least one orifice from which ink is expelled through an orifice plate having an inner surface and an outer surface from said inner surface of said orifice plate to said outer surface of said orifice plate, said at least one orifice having an opening at said outer surface with an elliptical shape including a major axis and a minor axis, said major axis having a dimension of from two to five times greater than said minor axis, each said major and minor axis parallel to said outer surface;

overlaying said orifice plate on said ink ejection chamber such that said inner surface is disposed opposite said ink ejector;

orienting an ink feed channel in a direction to deliver ink to said ink ejection chamber; and aligning said major axis substantially parallel to said ink feed channel direction which supplies sink into said ejection chamber.

20. A method in accordance with the method of claim 19 further comprising the step of creating said at least one orifice having said opening of said at least one orifice at said outer surface with a smaller area and substantially the same geometric shape as an opening of said at least one orifice at said inner surface.

21. A method in accordance with the method of claim 19 wherein said step of extending said at least one orifice through said orifice plate further comprises the step of forming a straight cross sectional orifice bore geometry joining said opening of said at least one orifice at said outer surface with said opening of said at least one orifice at said inner surface.

* * * * *

UNITED STATES PATENT AND TRADEMARK OFFICE

CERTIFICATE OF CORRECTION

PATENT NO. : 6,557,974 B1
DATED : May 6, 2003
INVENTOR(S) : Weber

It is certified that error appears in the above-identified patent and that said Letters Patent is hereby corrected as shown below:

Column 8,
Line 9, delete “stop” and insert therefor -- step --.

Column 10,
Line 20, delete “sink” and insert therefor -- ink --.

Signed and Sealed this

Twenty-ninth Day of June, 2004

JON W. DUDAS
*Acting Director of the United States Patent and Trademark Office*